US006963480B2

(12) United States Patent
Eccles

(10) Patent No.: US 6,963,480 B2
(45) Date of Patent: Nov. 8, 2005

(54) RETRACTABLE, NON-LETHAL HIGH VOLTAGES STUN SWORD

(76) Inventor: James Byron Eccles, 2908 Kerbey La., Austin, TX (US) 78734

( * ) Notice: Subject to any disclaimer, the term of this patent is extended or adjusted under 35 U.S.C. 154(b) by 174 days.

(21) Appl. No.: 10/607,676

(22) Filed: Jun. 26, 2003

(65) Prior Publication Data

US 2004/0264098 A1 Dec. 30, 2004

(51) Int. Cl.[7] ..... H01T 23/00
(52) U.S. Cl. ..... 361/232; 463/47.3
(58) Field of Search ..... 361/232; 463/47.3, 463/47.4

(56) References Cited

U.S. PATENT DOCUMENTS 3,998,459 A * 12/1976 Henderson et al. ..... 463/47.3
4,486,807 A * 12/1984 Yanez ..... 361/232
4,667,431 A * 5/1987 Mendicino ..... 43/6
5,041,951 A * 8/1991 Fan ..... 362/102
5,192,075 A * 3/1993 Ashihara ..... 463/47.4
5,287,255 A * 2/1994 Strodtman ..... 362/102
5,529,300 A * 6/1996 Frazier et al. ..... 463/47.4
5,986,872 A * 11/1999 Chaput ..... 361/232
6,091,597 A * 7/2000 Lin ..... 361/232
6,404,613 B1 * 6/2002 Dowling et al. ..... 361/232

* cited by examiner

*Primary Examiner*—Stephen W. Jackson
*Assistant Examiner*—Boris Benenson

(57) ABSTRACT

The invention is a high voltage stun device, unique in the sword-like configuration of its fully retractable, yet non-injurious, "blade," and its ability to deliver the pulse along the length of the "blade" as well as at the tip to a target at a distance far beyond arm's length. Stun batons, even retractable ones, have none of the preferred properties satisfied by the invention, including superior length of shocking surface, superior weighting and flexibility of the shocking surface, and simplicity of maintenance and repair. The "blade" of the invention is capable of expanding to a superior length that can keep a subject at a good defensive distance, yet be effective and retracted if he manages to get in close. With a moderation of the centrifugal force applied during blade deployment, the invention can be made to emulate a shorter sword, a long sword, and all lengths between. Further, the balance and dimensions of the device allow for fencing techniques to be utilized, while being portable and concealable unlike a traditional, fixed blade sword.

10 Claims, 6 Drawing Sheets

1cm = 1 inch

RETRACTABLE, NON-LETHAL HIGH VOLTAGES STUN SWORD

CROSS-REFERENCES TO RELATED PATENTS

U.S. Pat. No. 6,404,613 June, 2002 Dowling, et al.

U.S. Pat. No. 6,091,597 July, 2000 Lin

BACKGROUND OF THE INVENTION

This invention relates to high voltage, low amperage stun devices used primarily for self-protection. The embodiment of the invention is a non-lethal, non-cutting, sword-like device that is retractable into a portable size, but is a viable, self-defense weapon that presents no conflict with most state and local laws.

The prior art is two-fold: the sword, and high voltage self defense mechanisms. The particular type of sword that was the inspiration for the invention is the traditional Japanese sword with a rough blade length of 28–32 inches, (sharp along one side of its entire length as well as at the tip of the blade) and a blade-to-hilt length ratio of approximately three to one. This type of sword is known as a "katana."

High voltage self defense devices function by delivering a voltage pulse between two electrodes, typically spaced approximately one inch from each other to allow the current to visibly arc between the electrodes when activated. These devices are currently manufactured in various forms including 1) the traditional hand-held device with electrodes inches from the hand of the operator; 2) a compressed air model that fires a one-time, wire-attached pair of electrodes up to fifteen feet to a target; 3) "stun batons" which are similar to the hand-held model but for an extension of one to two feet from the hand-held trigger to the electrodes. Within the field of stun batons are both single and multi-stage retractable stun batons that extend an extra foot to eighteen inches from the handle.

Though closest in concept to the invention, multi-stage, retractable stun batons are easily distinguished from the invention on the basis of 1) the design of the retractable portion of a multi-stage stun baton has wider, and fewer telescoping segments (between 1 and 3), creating a shorter overall extended reach than the invention, requiring its user to be closer to the target than if he were using the invention (the preferred embodiment of which has 6 telescoping segments); 2) the resulting dimensions or ratio of shocking surface-to-handle in stun batons are not similar enough to that of a sword for sword techniques to be used; 3) the weight of the retractable portion of the stun baton is such that it is too heavy toward the tip to be used as a sword without either injuring the target with the blow or damaging the baton; 4) the integration of the conductive surface into the inert telescoping member of the stun baton necessitates replacement of the entire unit in case of damage to either of the conductive surfaces or the support member, whereas the independent nature of the mast and probes in the "blade" of the invention allows for rapid replacement of any malfunctioning, worn, or damaged component; 5) the conductive surfaces of stun batons cannot flex or twist, making them both susceptible to breakage as well as not making adequate contact with the target; and 6) the "blade" of the invention fully retracts into its handle, leaving only the very tip of the probes exposed—it extends retracts more fully, and in a more aesthetically pleasing manner, than any retractable stun baton.

BRIEF SUMMARY OF THE INVENTION

The invention is a self-defense device patterned after a Japanese sword, but instead of a long cutting blade finishing with a sharp point, the "blade" of the invention is a combination of twin parallel telescoping, metal probes flanking a light weight inert mast. This "blade" cannot cut or pierce, but instead delivers by contact at any point along its length or tip a disorienting and incapacitating high voltage, low amperage pulse. For portability, the "blade" of the invention fully telescopes from, and retracts into, the hilt. Further, the blade can be deployed instantly by centrifugal force.

The invention solves the problems it was intended to address: swords are illegal to carry for good reason: they are designed to be lethal. However, especially for those skilled in the use of the sword, the ability to use a sword-like device as a modern defense weapon is reborn by using high voltage as a non-lethal, non-cutting, non-puncturing, and practically non-injurious substitute for sharpened steel. Even for those not skilled in the use of a sword, the ability to keep an attacker a considerably further distance away than any stun gun or stun baton can (simply by nature of the length of the invention's "blade"), to easily wield the device because of its weighting, the ability to maintain and replace components due to the independent operation of the components of the "blade," the forgiving nature of the "blade," wherein it flexes and turns to make contact and avoid damage, and the fact that the "blade" fully retracts into a slim, compact form clearly distinguish this invention from any patented device.

DETAILED DESCRIPTION

Figure 2:
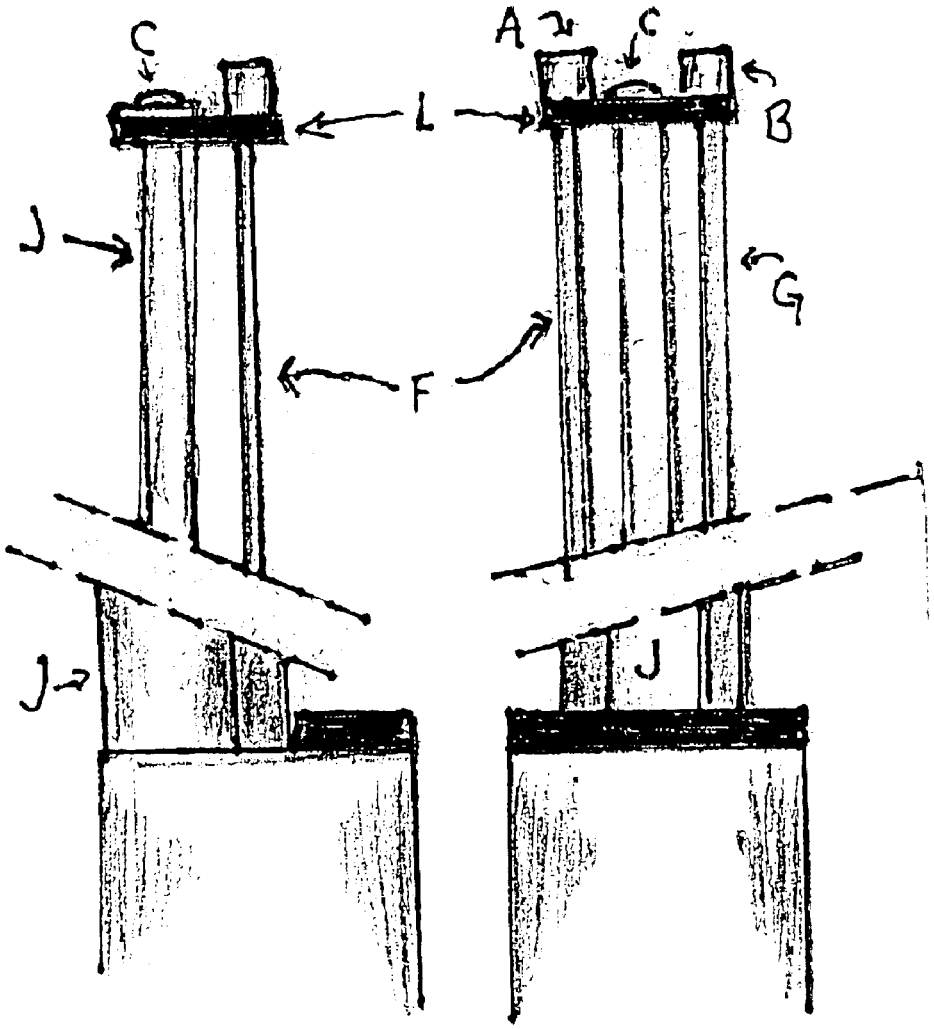
FIG. 2: Sketches of Tip of Invention And Top of Hilt (Front and Left Views)
Figure 6:
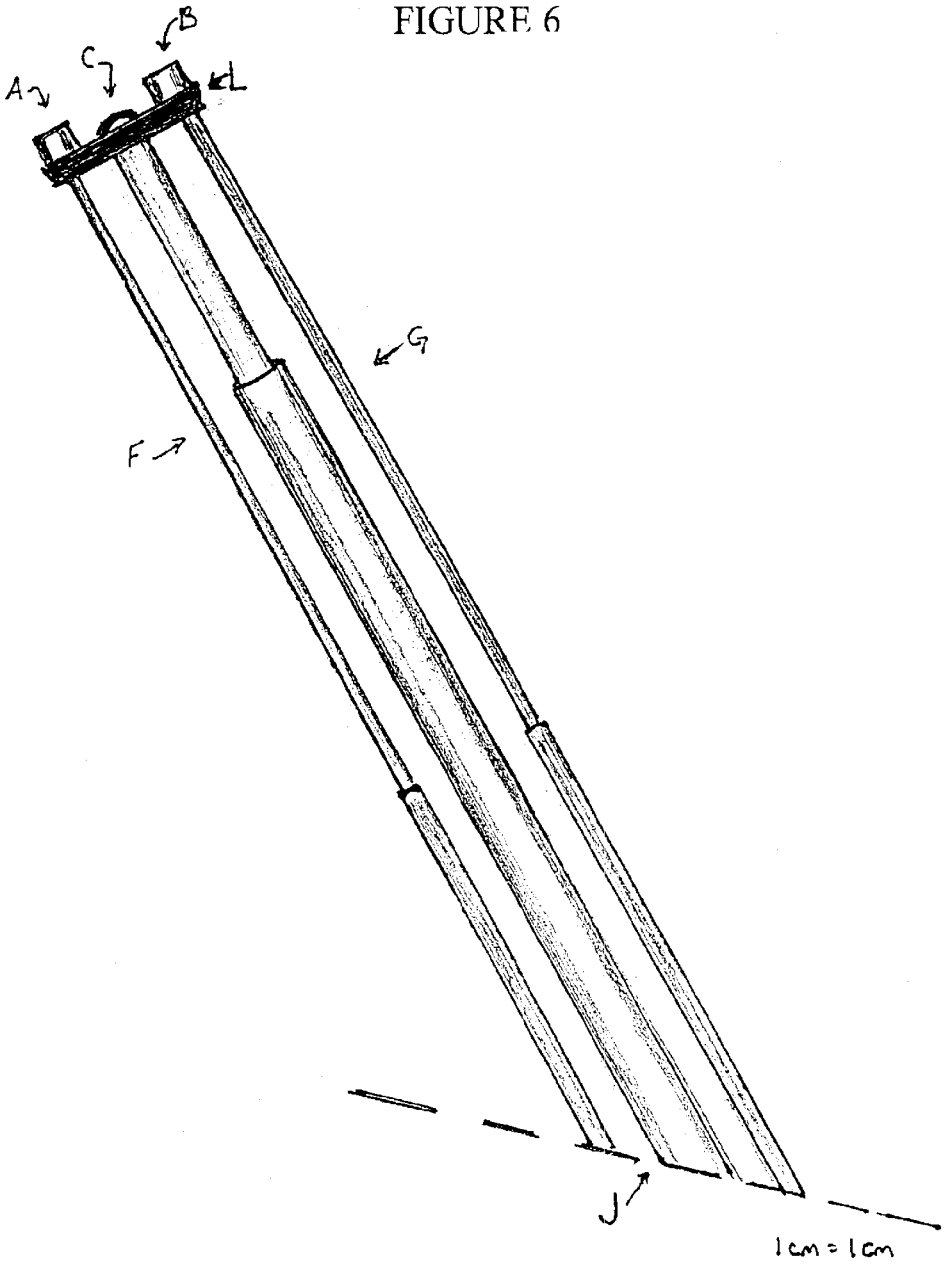
FIG. 6: Detail of Top of Blade Toward Tip (Blade Deployed) Showing Independent Segmentation of Mast and Probes

The "mast" (labeled "J" in FIGS. 2, 3, and 6) is an inert (i.e. non-conductinve), multi-segmented telescoping rod. The "probes" (labeled F and G in FIGS. 2, 3, and 6) are two, multi-segmented, telescoping metal rods. In the construction of the preferred embodiment, the mast is made from a telescoping, hollow cylinders of fiberglass or carbon fiber, and the probes are hollow, telescoping, interconnected stainless steel spheres finishing with an approximately 1 cm. solid cylinder. In the preferred embodiment, the mast and probes are either five or six segmented sections each. The conductivity between the segments of the probes is made constant by a fully contained flanged cuff at the base of each segment: the cuff surrounding the base of the probe segment, and the flange in constant contact with the segment that surrounds it. The mast segments are slightly widened at their base, creating a friction lock between all segments when extended, and an overlap of approximately one to one and a half inches between segments for structural integrity.

Figure 1:
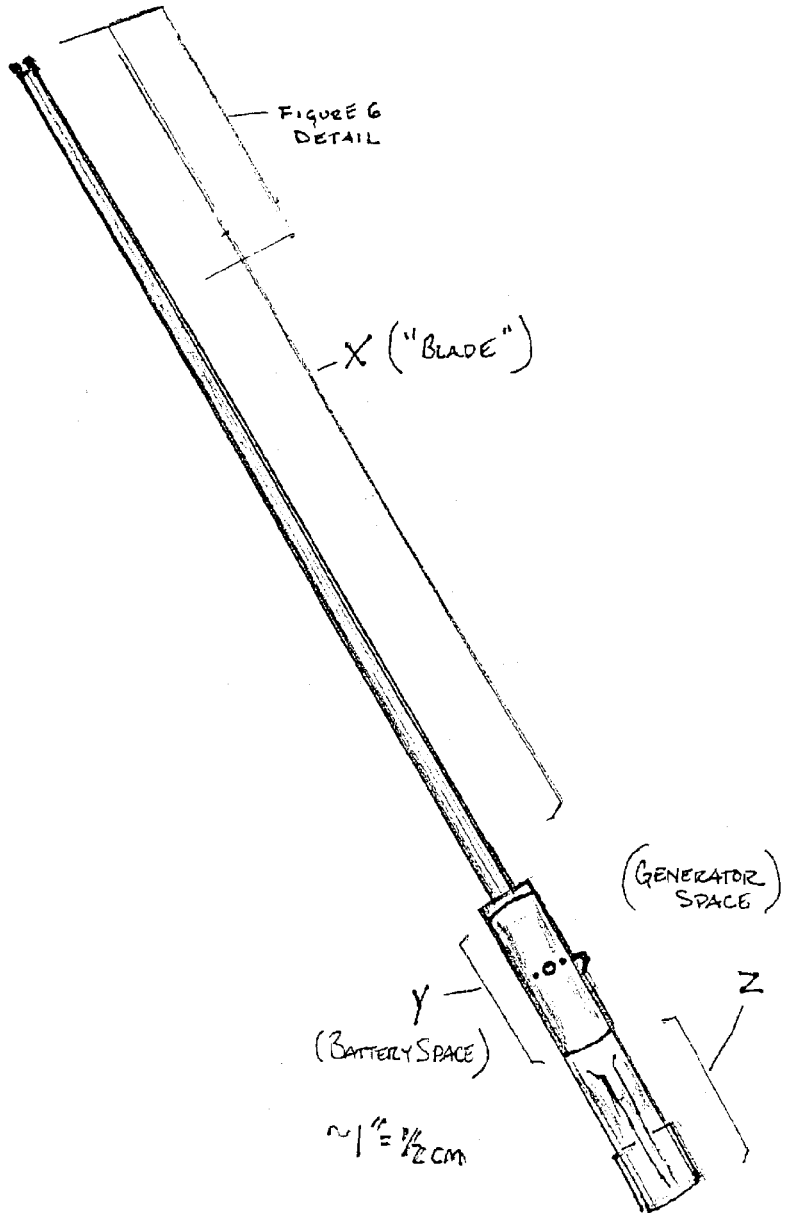
FIG. 1: Broad Sketch of Invention With Blade Deployed
Figure 3:
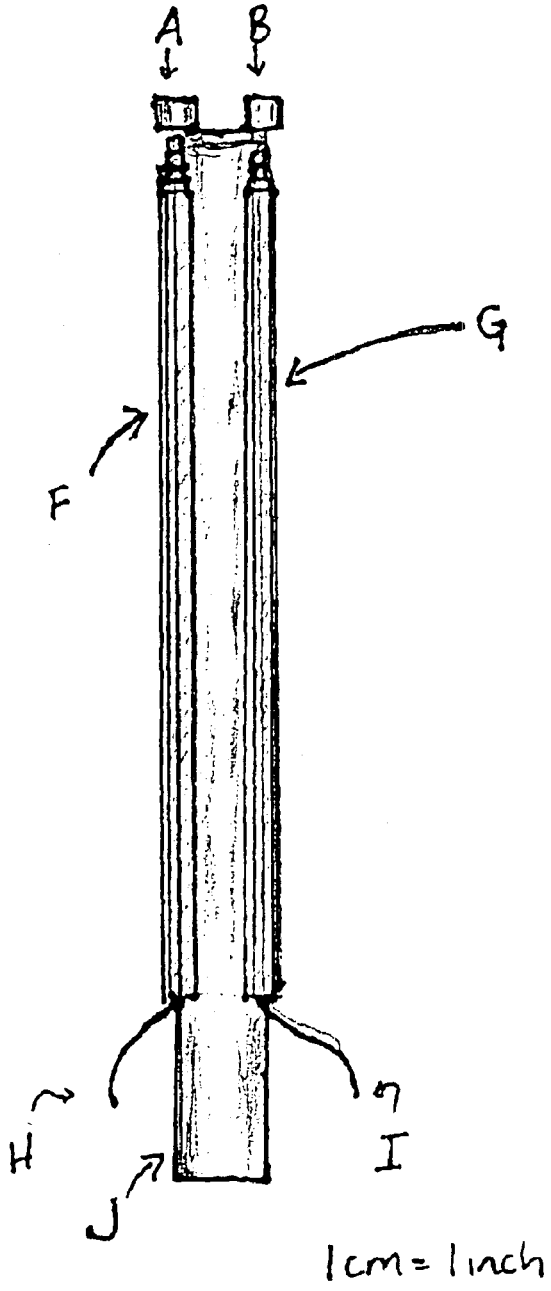
FIG. 3: Orientation of Components of Blade Assembly (Blade Retracted)

The probes are heavily insulated on the outside of their first (largest) segment, and are affixed to the mast within the hilt. (See FIG. 3). At the back end of the probes, insulated wires are connected to the probe though the probe's insulation. (FIG. 3, H and I). At the tip of the blade is the tip spacer/connector: a piece of molded plastic that connects the tip of the mast to the tips of the probes, and maintains the required space and parallel orientation of the probes and mast. (Labeled as "L" on FIGS. 2, 5, and 6). Thus, "deployment" of the blade (FIG. 1, labeled X) from its fully retracted state to fully extended state is actually the telescoping of three separate rods, bonded together at their first segment and connected at their tips. (See FIG. 6).

Figure 4:
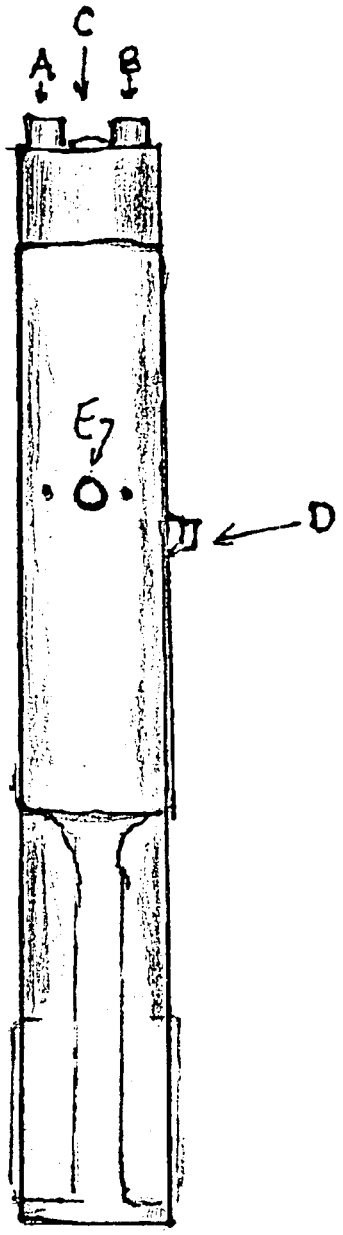
FIG. 4: Hilt Assembly (Blade Retracted)
Figure 5:
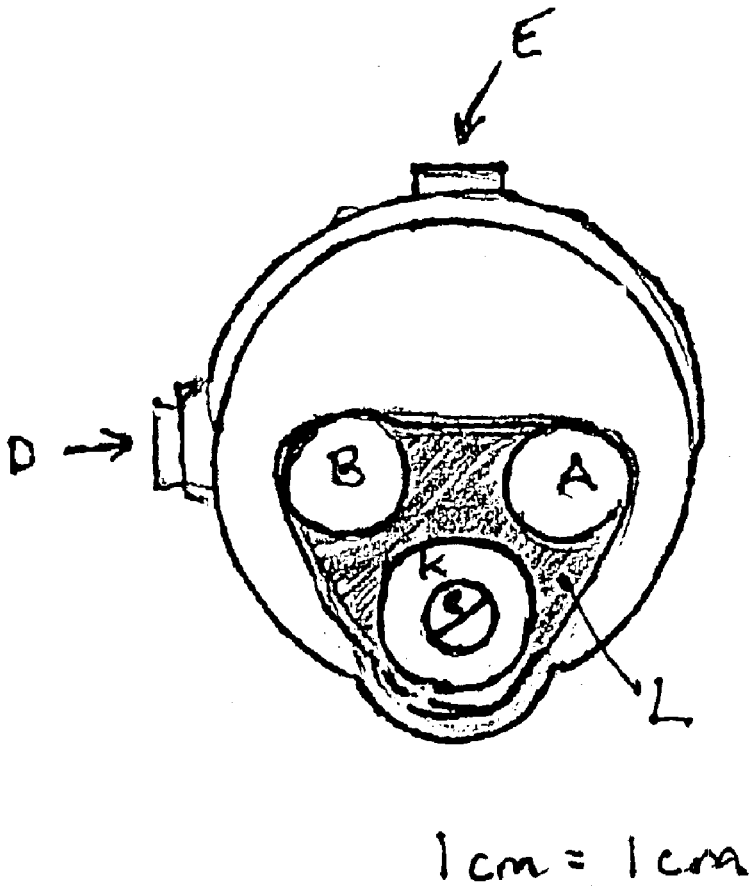
FIG. 5: Tip of Invention—Top View (Blade Retracted)

The preferred embodiment is powered by two 9 volt batteries. The preferred embodiment has two switches: a safety switch (FIGS. 4 & 5, labeled D) and a trigger (FIGS. 4&5, labeled E). When the safety is depressed, it completes the circuit from one of the poles of the batteries to the generator circuitry, as well as activates a status light on the side of the unit. The trigger switch is then able to supply the other polarity of the batteries to the generator circuitry when depressed. Once the battery power has been modified by the generator (through coil or through the timed discharge of capacitors, depending on the type of stun generator used) the modified electrical signal is transferred through insulated wires (FIG. 3, labled H and I) to the back end of the probes.

The electrical signal then travels the entire length of the blade, including the two bulbs of the probes at the tip (FIGS. 2–6, labeled A and B), regardless of its state of deployment. The spark will bridge at the point of greatest conductivity. This point varies along the blade, except when the blade is energized within 0.5 inches (approximately) of a conductive target. As the probes are set apart at just under one inch, the presence of a conductive material between the poles at a distance from the coils of less than that one inch will draw the pulse, and thus become the pathway of the spark. For demonstration purposes, an optional and adjustable conductive bridge (Exhibit 5 labeled K) is placed between the probes atop the tip spacer/connector insures that the spark will always arc at the tip unless a target is contacted.

In testing the final prototype, the device is very durable, withstanding several hundreds of moderate to heavy strikes on a conductive target, following hundreds of blade deployments. The design of the blade allows for strikes to the blade itself to handle a lateral strike, with the probes both flexing and rotating to allow the force to be delivered primarily to the mast without misshaping the probes, and distorting the axis of the blade by only about 10 degrees at the tip, which is corrected by re-deployment. Although the invention has been described and illustrated with reference to the preferred embodiment, it should be understood that the claims made in this application are not limited to the preferred embodiment, but would include numerous modifications within the scope of the claims.

What I claim as my invention is:

1. A compact, portable hand-held stun device that converts quickly into an elongated, sword-like configuration comprising:

a handle or hilt with an interior capable of fully containing a high voltage generator, battery units, wiring and insulation, and the components of the blade defined as the two probes, support mast, the tip connector/spacer, and optional conductive plate described in this claim;

two fully contained and concealed, when collapsed, telescoping, multi-segmented, metal probes culminating with a dull knob at the tip of each which protrude from the top of the hilt when the segments are collapsed;

one fully contained and concealed, when collapsed, multi-segmented, telescoping, inert support mast;

an inert tip connector/spacer that connects the mast and the two probes the ends of the top-most smallest segment of each of the probes and mast;

a small, adjustable and optional conductive plate atop the tip connector/spacer at the termination of the mast at the connection of top of the smallest mast segment to the tip connector/spacer to direct an arc between the probes at the tip upon activation of the device when no other means of conduction between the two probes is present; and, a switching mechanism to enable the high voltage generator to deliver the pulse via the metal probes.

2. The device described in claim 1, wherein the hilt contains a battery powered, high voltage, low amperage generator capable of producing said high voltage potential delivered to two oppositely charged terminals, which in turn are connected to the probes.

3. The device described in claim 1, wherein the two probes are parallel to each other, and flank and run parallel to the inert mast—connected only at the tip of the probes and mast, and at the base of the probes and mast within the hilt, but otherwise are separate and independent.

4. The device described in claim 1, wherein the blade of the device is rapidly and smoothly deployed or extended from inside the hilt by means of centrifugal force, and by moderation of the centrifugal force applied during blade deployment, the invention can be made to emulate a shorter sword or a longer sword.

5. The device described in claim 1, wherein the probes will slightly rotate around the mast and flex on impact—allowing stress to be absorbed by the mast, as well as allowing the probes to flex and rotate to make better contact with a target.

6. The device described in claim 1, wherein the blade is lightweight, such that the balance point of the device remains close to the top of the hilt when the blade is fully deployed or extended, as opposed to higher along the blade.

7. The device described in claim 1, wherein each of the telescoping probes and mast are not connected to each other except at the tip and within the hilt, and are capable of being replaced or serviced independent of any other component.

8. The device described in claim 1, wherein each segment of the probes maintains constant conductivity with all other segments within that probe, allowing the blade to deliver the electrical impulse at any point along its length or tip, whether extended or retracted or in any phase of deployment between those two extremes.

9. The device described in claim 1, wherein the length of the blade when extended or deployed versus the hilt is comparable to that of a sword: approximately 3/1 or greater ratio, with a blade length of greater than 26 inches measured from the top of the hilt to the tip of the blade being achieved when the blade is extended or deployed.

10. The device described in claim 1, wherein the probes are maintained at their full, extended position by nature of a friction lock between the segments in the mast, and will remain extended until force is applied at the tip to compress the blade sections within themselves and back into the largest diameter segments of the probes and mast located in the hilt.

* * * * *